US007554026B2

(12) United States Patent
de Moraes

(10) Patent No.: US 7,554,026 B2
(45) Date of Patent: Jun. 30, 2009

(54) ELECTRONIC DEVICE FOR THE PRODUCTION, PLAYING, ACCOMPANIMENT AND EVALUATION OF SOUNDS

(75) Inventor: Aurélio Rótolo de Moraes, Curitiba PR (BR)

(73) Assignee: Audiobrax Industria E Comercio De Produtos Eletronicos S/A, Curitiba PR (BR)

( * ) Notice: Subject to any disclaimer, the term of this patent is extended or adjusted under 35 U.S.C. 154(b) by 0 days.

(21) Appl. No.: 11/694,299

(22) Filed: Mar. 30, 2007

(65) Prior Publication Data

US 2007/0234889 A1 Oct. 11, 2007

Related U.S. Application Data

(63) Continuation of application No. PCT/BR2005/000210, filed on Oct. 3, 2005.

(30) Foreign Application Priority Data

| | | | |
|---|---|---|---|
| Oct. 1, 2004 | (BR) | ..... | 0404419 |
| Nov. 5, 2004 | (BR) | ..... | 0404846 |
| Sep. 23, 2005 | (BR) | ..... | C1 0404419 |
| Sep. 23, 2005 | (BR) | ..... | C1 0404846 |

(51) Int. Cl.
*G10H 7/00* (2006.01)

(52) U.S. Cl. ..... 84/615; 84/653; 84/601

(58) Field of Classification Search ..... 84/600–607, 84/615, 653; 434/307 A
See application file for complete search history.

(56) References Cited

U.S. PATENT DOCUMENTS 4,757,736 A * 7/1988 Tajima et al. ..... 84/667
5,394,784 A * 3/1995 Pierce et al. ..... 84/464 A (Continued)

FOREIGN PATENT DOCUMENTS

EP 1 073 034 1/2001

(Continued)

OTHER PUBLICATIONS

Dennis Hromin, Michael Chladil, Natalie Vanatta, David Naumann, Susanne Wetzel, Farooq Anjum and Ravi Jain; *CodeBLUE: A Bluetooth Interactive Dance Club System*; IEEE; 2003; pp. 2814-2818.

(Continued)

*Primary Examiner*—David S. Warren
(74) *Attorney, Agent, or Firm*—Alston & Bird LLP

(57) ABSTRACT

One describes an electronic device for the production, playing, accompaniment and evaluation of sounds, comprising means do be associated to audio system and, the device comprising a) a processing unit which (i) produces musical instrument sounds from an user's touches; (ii) plays music sounds, adds musical effects, alters reproduction parameters of the music playing; (iii) mixes sounds produced from the user's touches with music sounds played; and (iv) comprises music parameters able to evaluate an instrumental accompaniment performance resulted from the instrumental music sounds produced by the user's touches; b) the processing unit comprising a touch sensitive surface which comprises: (i) touch sensors arranged under said surface providing regions sensitive to touches; and (ii) Leds distributed under said surface and controlled by a microprocessor providing a luminous indication sequence according to the music sounds played, said luminous indication sequence being following by touches of the user in this surface.

27 Claims, 12 Drawing Sheets

U.S. PATENT DOCUMENTS

| | | | | |
|---|---|---|---|---|
| 5,557,683 | A * | 9/1996 | Eubanks | 381/86 |
| 5,656,789 | A * | 8/1997 | Nakada et al. | 84/477 R |
| 5,841,052 | A * | 11/1998 | Stanton | 84/600 |
| 5,986,200 | A * | 11/1999 | Curtin | 84/609 |
| 6,114,774 | A * | 9/2000 | Fiegura | 307/9.1 |
| 6,390,923 | B1 * | 5/2002 | Yoshitomi et al. | 463/43 |
| 6,410,835 | B2 * | 6/2002 | Suzuki et al. | 84/464 R |
| 6,645,067 | B1 * | 11/2003 | Okita et al. | 463/7 |
| 6,687,193 | B2 * | 2/2004 | Jung | 369/4 |
| 6,835,887 | B2 * | 12/2004 | Devecka | 84/743 |
| 6,838,610 | B2 * | 1/2005 | de Moraes | 84/730 |
| 6,874,003 | B2 * | 3/2005 | Morohashi | 707/204 |
| 7,042,814 | B2 * | 5/2006 | Yamada et al. | 369/30.26 |
| 2003/0167908 | A1 * | 9/2003 | Nishitani et al. | 84/723 |
| 2006/0050894 | A1 * | 3/2006 | Boddicker et al. | 381/77 |
| 2006/0052167 | A1 * | 3/2006 | Boddicker et al. | 463/37 |
| 2006/0141435 | A1 * | 6/2006 | Chiang | 434/307 A |
| 2006/0228683 | A1 * | 10/2006 | Jianping | 434/307 A |
| 2007/0234888 | A1 * | 10/2007 | Rotolo de Moraes | 84/730 |

FOREIGN PATENT DOCUMENTS

| | | |
|---|---|---|
| EP | 1 260 979 | 11/2002 |

OTHER PUBLICATIONS

International Preliminary Examination Report for PCT/BR2005/000210 completed Nov. 11, 2006.

International Search Report for PCT/BR2005/000210 completed Dec. 19, 2005.

Written Opinion of the International Searching Authorityfor PCT/BR2005/000210.

Response to Written Opinion for PCT/BR2005/000210 dated Aug. 1, 2006.

* cited by examiner

ELECTRONIC DEVICE FOR THE PRODUCTION, PLAYING, ACCOMPANIMENT AND EVALUATION OF SOUNDS

CROSS-REFERENCE TO RELATED APPLICATIONS

This application is a continuation of International Patent Application No. PCT/BR2005/000210, filed Oct. 3, 2005 which designated the United States and was published under PCT Article 21(2) in English and which is hereby incorporated in its entirety by reference.

BACKGROUND OF THE INVENTION

1. Field of the Invention

This invention refers to an electronic audio device, fastened or not to the body of a user.

2. Description of the State of the Art

The agitation and intense work of everyday life in the big cities has deprived many people from their much-longed moments of leisure. The daily routine, many times keeps people isolated in commercial buildings, partly during their lunch time, on their way home or to work, etc. In leisure moments, such as walks in parks, resting at the beach or even at home, repetitive activities usually become boring and upsetting.

In many different cultures, music serves as a natural means of fun, unwinding and relaxation. Everyday life makes people seek some way of expressing themselves freely and individually through music, for instance, or some musical instrument.

The idea of the present invention is to create moments of peace, relaxation and pleasure for users, by means of an electronic instrument, object of the present invention, which gathers audio and musical resources.

Karaoke instruments of today evaluate only one's voice, which accompanies the music, and it is for domestic use, as well as entertainment in bars or restaurants. The karaoke of the present invention, in addition to evaluating the user's voice, also evaluates the instrumental accompaniment of the music. Through user iteration, it is possible to produce musical instrument sounds (percussion, keyboard, string or blow instruments) mixed with the music as accompaniment. In addition, this karaoke device is portable and can be taken by the user anywhere he goes.

BRIEF SUMMARY OF THE INVENTION

The purpose of the present invention is to provide the user an electronic instrument strapped to one's body or not (depending on the occasion), that can play a song, mix into this song instrumental music from musical instruments (percussion, keyboard, string or blow instruments), or sound effects controlled by the user and place them for performance evaluation in this musical accompaniment activity. Thus, the instrument of the present invention acts as a portable equipment to provide the user pleasant, fun, relaxing and pleasurable moments especially in idle and personal situations of every day life.

The electronic instrument referred to by this invention is composed by a processing unit which is fixed to an adjustable elastic belt in order to fasten the instrument onto one's body, a remote sensor and an adapter. The present invention's instrument is portable, made for use in different places and situations, presenting two preferred embodiments featuring the same activity but in different ways.

The first preferred embodiment consists of a kit made up of an adapter and a processing unit completely functional and able to produce musical instrument sounds (percussion, keyboard, string or blow instruments), sound effects, play a song, alter play parameters, mix sounds and evaluate user performance in vocal and/or instrumental accompaniment. This unit also accepts the use of a remote sensor, which sends commands to the processing unit, for it to produce sounds, effects, alter parameters of a song based on these commands.

The second preferred embodiment consists of a processing unit, a remote sensor, and an adapter, and this kit features the same functionalities of the first preferred embodiment. The processing unit works based on commands received from the remote sensor, being able to produce musical instrument sounds (percussion, keyboard, string or blow instruments), sound effects, play a song, alter play parameters, mix sounds and evaluate user performance in vocal and/or instrumental accompaniment.

Another important functionality is that the device can be used by a DJ (Disk Jockey), the user being provided with the same resources used by a sound professional/operator known as a DJ, also being essential the use of the Jog disk.

One of the main characteristics of this device, in both preferred embodiments, is the function to produce a score or grade at the end of the performance of the user/DJ in the accompaniment of the song's instrumental and/or vocal. Different difficulty levels can be selected to define a given evaluation level. Leds (light emission diodes) present on the Jog disk and on a pad of the processing unit, and a remote sensor provide visual indication and aid the user in his performance, indicating, in the form of points or regions, the moment to touch the surface and at the respective intensity.

The processing unit also features applications such as a personal agenda, calculator, games, clock, alarm clock, music list editor, battery meter, etc. This unit can also be used as a data storage unit for a computer, saving information in flash storage memory or in the memory card.

The adapter consists of a remote device able to receive the resulting sound of the processing unit and/or send a sound to this unit. The purpose of this adapter is to deliver audio and video signals onto any audio and video equipment.

According to the teachings of the invention, the electronic device for the production, playing, accompaniment and evaluation of sounds, comprising means do be associated to audio system, comprises: a) a processing unit which (i) produces musical instrument sounds from an user's touches; (ii) plays music sounds, adds musical effects, alters reproduction parameters of the music playing; (iii) mixes sounds produced from the user's touches with music sounds played; and (iv) comprises music parameters able to evaluate an instrumental accompaniment performance resulted from the instrumental music sounds produced by the user's touches; b) the processing unit comprising a touch sensitive surface which comprises: (i) touch sensors arranged under said surface providing regions sensitive to touches; and (ii) Leds distributed under said surface and controlled by a microprocessor providing a luminous indication sequence according to the music sounds played, said luminous indication sequence being following by touches of the user in this surface.

BRIEF DESCRIPTION OF THE DRAWINGS

This invention will be thereafter described in more details based on an example of execution represented in the drawings. The figures show.

DETAILED DESCRIPTION OF THE INVENTION

Figure 1:
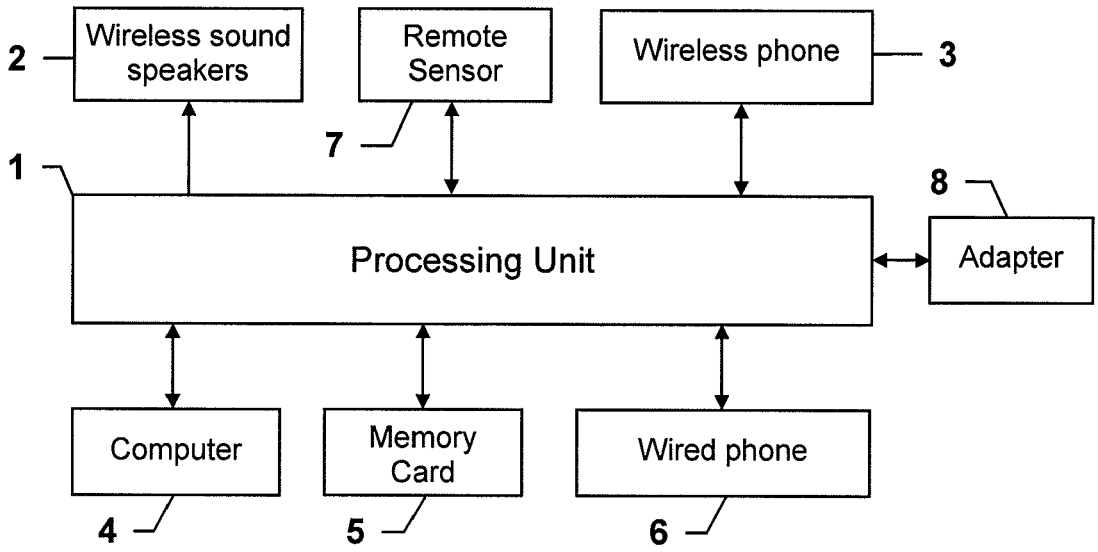
FIG. 1—is a functional block diagram of the first preferred embodiment of the device object of the present invention.

The present invention is divided into two preferred embodiments, that perform the same functionalities, but in different ways. FIG. 1 presents the processing unit 1, the remote sensor 7, and the adapter 8, objects of the present invention. The processing unit 1 interacts with other accessories such as computer 4, accesses a memory card 5, sends sounds to wireless sound speakers 2, sends to/receives from wireless phone and/or microphone 3, wired phone and/or microphone 6.

Figure 2:
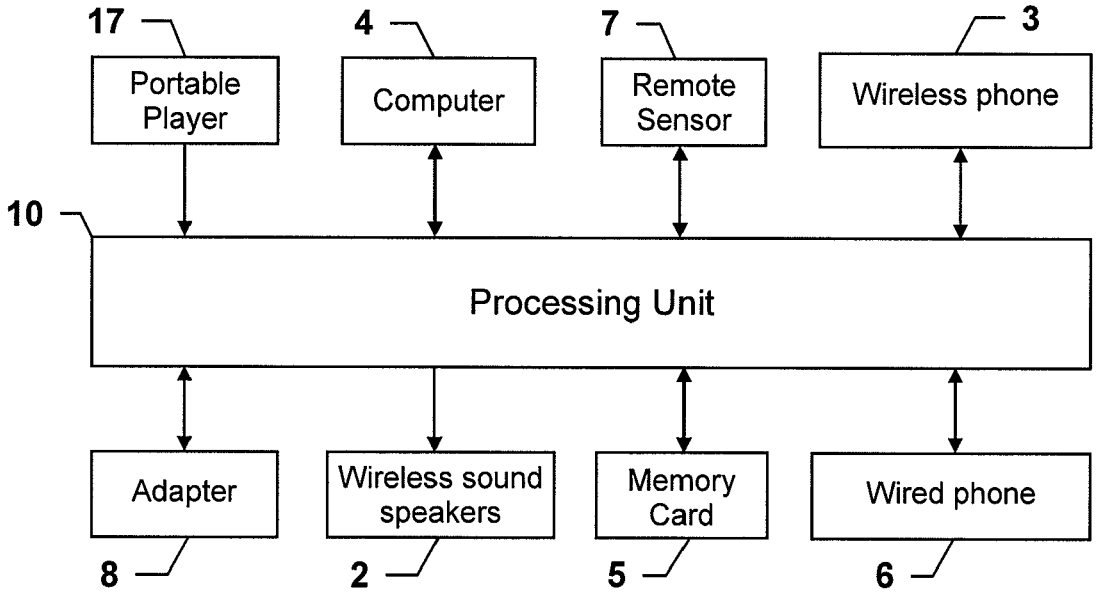
FIG. 2—is a functional block diagram of the second preferred embodiment of the device object of the present invention.

The second preferred embodiment of the device, object of this invention, is shown in the block diagram of FIG. 2. This embodiment comprises a processing unit 10, a remote sensor 7 and a adapter 8, composes the electronic device object of the present invention. The processing unit 10 interacts with other accessories such as the computer 4, memory card 5, wireless sound speakers 2, wireless phone and/or microphone 3, wired phone and/or microphone 6 and portable player 17.

The first preferred embodiment is characterized in that a processing unit 1,20,50 is operated independently of the remote sensor 7,100,110, that is, requiring only one accessory for its sound to be heard by the user, such as wireless sound speakers 2. In this case, the remote sensor 7,100,110 features an additional means for user interaction.

The second preferred embodiment is distinguished from the first for the fact that the processing unit 10,80 requires the remote sensor 7,100,110 to operate, complementing the functionalities for this preferred embodiment. In addition, this unit accepts the sound of the portable player 17 to actuate with other sounds.

Figure 3:
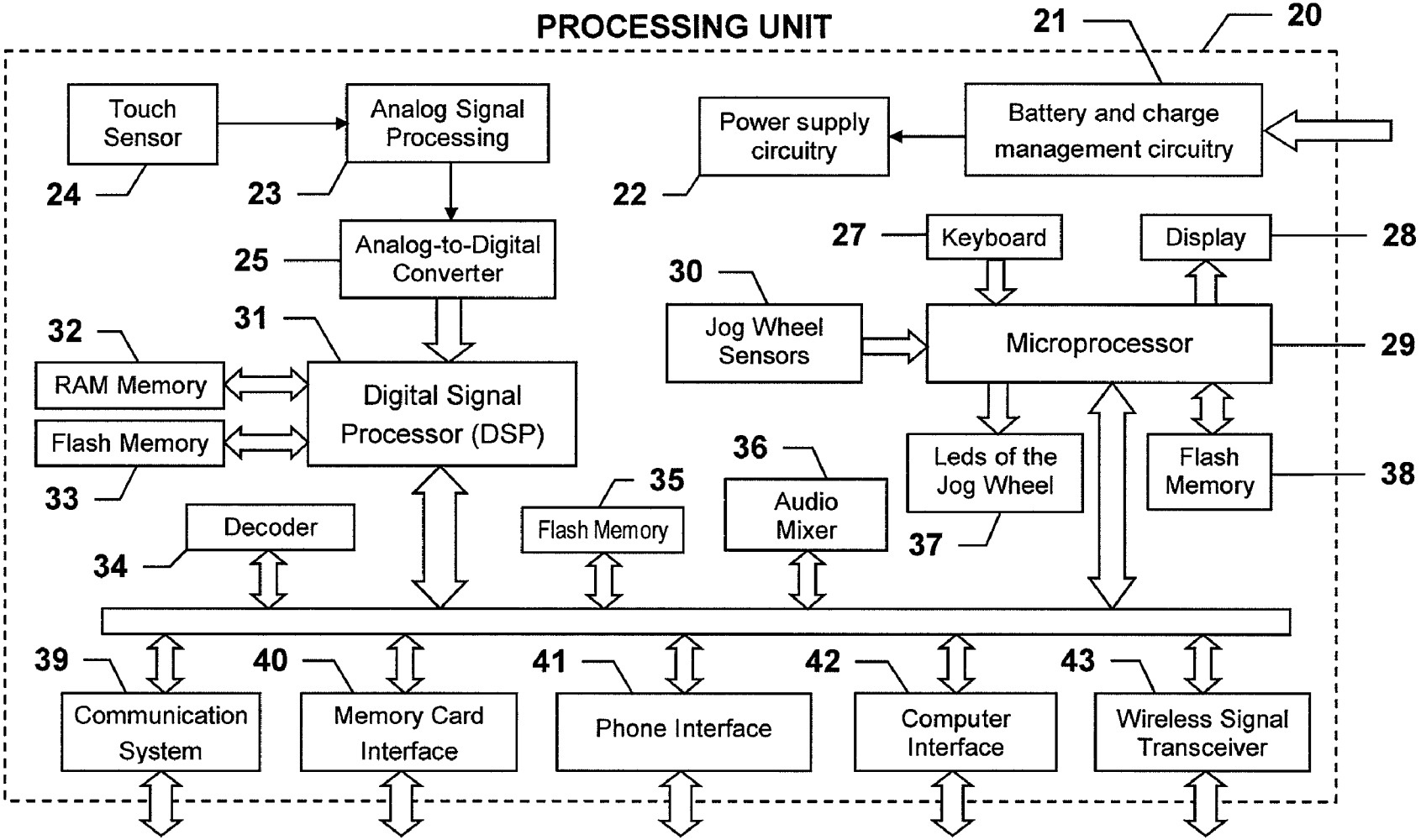
FIG. 3—is a block diagram of the first modality of the processing unit, in reference to the first preferred embodiment of the device object of the present invention.

The block diagram of the first modality of the processing unit 20, in reference to the first preferred embodiment, is presented on FIG. 3. This unit is equipped with analogical and digital electronic circuits which, in association with the software installed, constitute a system able to produce musical instrument sounds (percussion, keyboard, string or blow instruments), play music, add musical effects, alter play parameters of the music playing, mix sounds and evaluate the user ability in instrumental and/or vocal performance, directly or indirectly acting in all of the functionalities.

The processing unit 20 is supplied by a rechargeable battery and charging management 21, with the power supply circuit 22 being responsible for providing regulated voltages to the remaining circuits.

The Jog disk 127 features different functionalities in the device. A spinning disk simulates a conventional turntable, although it does not spin by itself, but it can act on the sound effects attributed in the playing music. By spinning the Jog disk 127 clockwise, a function or command is progressively actuated, while anticlockwise, regressive actuation of the function or command is achieved. The speed at which the disk is spun by the hand and/or finger of the user is also taken into consideration. In addition, the Jog disk 127 is sensitive to touch/beat by the user's hand and/or fingers, and can be used in the accompaniment of a song, for example.

The Jog disk surface 127 has at least one touch sensor 24 below its surface, which detects beats/touches by the hand and/or fingers of the user, being sensitive to frequency and intensity. The touch sensor 24 can be a piezoelectric transducer, field effect, or a pressure, force, vibration or acceleration sensor. The signals of this sensor are conditioned through the analog signal processing 23 and converted into digital words by means of an analog-to-digital converter 25, being the data read by the Digital Signal Processor or DSP 31.

The DSP 31 runs the entire processing of digital sounds, signals and communications associated to this device. This device uses two types of memory:—RAM memory 32, which temporarily stores data and;—Flash memory 33, which contains the software of the system, called firmware, synthesized digital sounds, samples, sound effects and other essential data for the unit's functioning. The DSP 31 also gains access to files and/or data contained in the flash memory for data storage 35. It is also responsible for musical play, instrumental sounds production (percussion, keyboard, string or blow instruments), alteration of play parameters, sound mixing, addition of sound effects (echo, delay, pitch, distortions, etc.), interpretation and execution of musical and/or instrumental karaoke sounds, as well as user performance from these files, among other attributes.

When sounds or a song are presented encoded and/or compacted, the DSP 31 can use the decoder 34 to obtain intelligible data for processing. Different audio channels, analogical or digital, can result from the processing of sound by the DSP 31, where the audio mixer 36 is able to receive the sounds from these channels and mix them to produce a single resulting sound.

The computer interface 42 provides a means of communication with the computer in order to update firmware, add, or exclude stored flash memory data 35, or memory card data 5, through the memory card interface 40. The sounds resulting from the processing unit 20 can be sent to the computer 4 as well as computer sounds 4 can be transmitted to this unit. It is important to point out that this interface is compatible with most communication ports with wire or wireless communication systems used in PCs.

The earphone and/or microphone interface 41 converts the resulting digital sound into proper analogical sounds to drive the wireless earphone/mic sets 6. In the same way, the microphone's analogical signal is converted into digital words sent to the DSP 31, which carries out the required processing.

The communication system 39 has the function of providing communication with the remote sensor 7,100,110 to receive and/or send commands. This communication can be bidirectional (two-way) and can be achieved by radio frequency, ultrasound, infrared light or electric wiring/cabling, as well as an association of two or more of these means of communication.

The resulting sound can be sent to wireless sound speakers 2 and/or wireless earphones. To attain these goals, the use of the wireless signal transceiver 43 is made. This transceiver is able to send and receive sounds, analogical or digitized, to any compatible device, including wireless sound speakers 2 and wireless earphone and/or microphone 3. In addition, the wireless signal transceiver 43 can send the resulting sound of the processing unit 20 to any equipment able to receive this sound and reproduce it, or to the adapter 8 as well, making available this sound in the form of analogical or digital audio signals. This transceiver, which communicates and is controlled by DSP 31, is also capable of sending/receiving digitized commands. The wireless signal transceiver 43 can communicate in single or two-way form, and the communication can be by means of radio frequency, ultrasound or infrared light, as well as an association of two or more of these means of communication.

The microprocessor 29 processes user interface devices such as the display 28, keyboard 27 and Jog disk sensors 30, as well as controls the remaining system components, working in conjunction with the DSP 31. The display 28 shows the user the instrument's operational status, menus, functions, charts and other visual information. The keyboard 27 works as a command input, gathering user press-keys. The microprocessor 29 has a specific flash memory 38, which contains the firmware that defines its functionalities and all operations that this device should execute. The Jog disk sensors 30, which have the purpose of detecting the speed and angular position of the disk, provide digital signals which are sent to the microprocessor 29, and which run the respective local processing, sending them to the DSP 31 in the form of commands.

The Leds of the Jog disk 37 are distributed in suitable form below the Jog disk 127 and are controlled by the microprocessor 29. The function of these leds is to provide luminous indication to the user in reference to actions that need to be taken, that is, inform the user the disk spot that should be touched as well as the moment and intensity of the respective touch.

Figure 4:
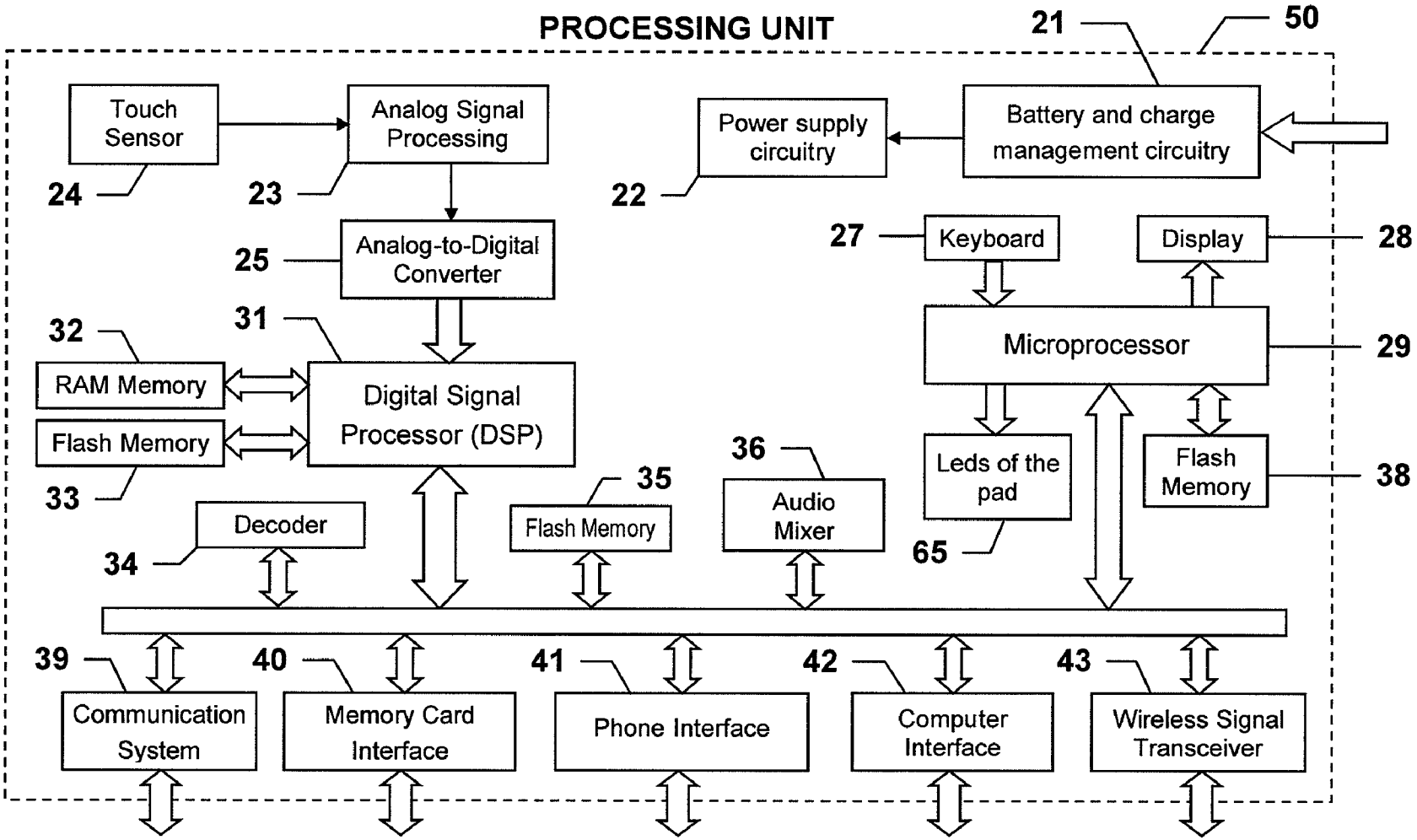
FIG. 4—is a block diagram of the second modality of the processing unit, in reference to the first preferred embodiment of the device, object of the present invention.

The block diagram of the second modality of the processing unit 50, in reference to the first preferred embodiment, is presented on FIG. 4. This second modality is distinguished from the first for presenting a sensitive surface or touch sensitive pad in place of the Jog disk 127. This block diagram is identical to the one of FIG. 3, with the exception of the absence of Jog disk sensors 30 and the fact of the leds being related to the pad 169 and called pad leds 65.

Figure 5:
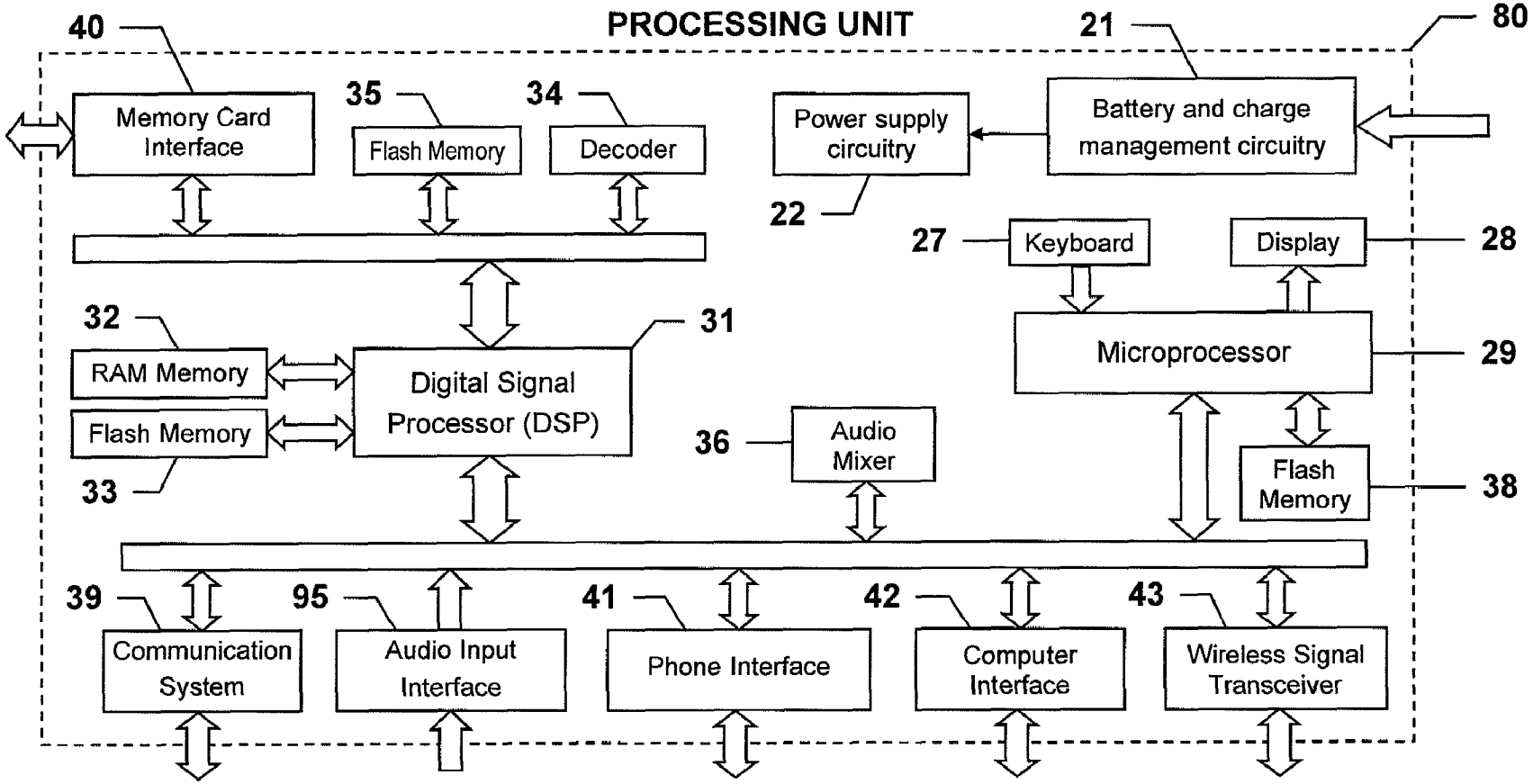
FIG. 5—is a block diagram of the third modality of the processing unit, in reference to the first preferred embodiment of the device object of the present invention.

FIG. 5 presents a block chart of the third modality of the processing unit 80, in reference to the second preferred embodiment of the device, object of the present invention. This third modality is distinguished from the first and second modalities for not presenting a Jog disk 127 or coupled pad 169, since it receives commands from a remote sensor 7,100, 110, which has a Jog disk 127 or pad 169. This block diagram is similar to the block diagram of the first modality of the processing unit 20, but it does have a touch sensor 24, analog processing circuit 23, analog-to-digital converters 25 and Jog disk leds 37. In addition, the processing unit 80 accepts sounds from a portable player 17 by means of an audio input interface 95 to mix with other sounds.

The audio input interface 95 is able to receive analogical or digitized sounds from a music/potable sound player 17. In addition, it can also receive/send command to/from the portable player 17. If the input sound is analogical, this interface has the means of converting analogical signals into digital words. The DSP 31 runs the control and reading of data received by the audio input interface 95.

It is important to point out that the functionalities conducted by the second preferred embodiment of this invention's device are the same but fulfilled in a different manner. In the second preferred embodiment, the processing unit 10,80 requires the remote sensor 7,100,110 to perform the same functionalities as the first built model of the instrument.

Figure 6:
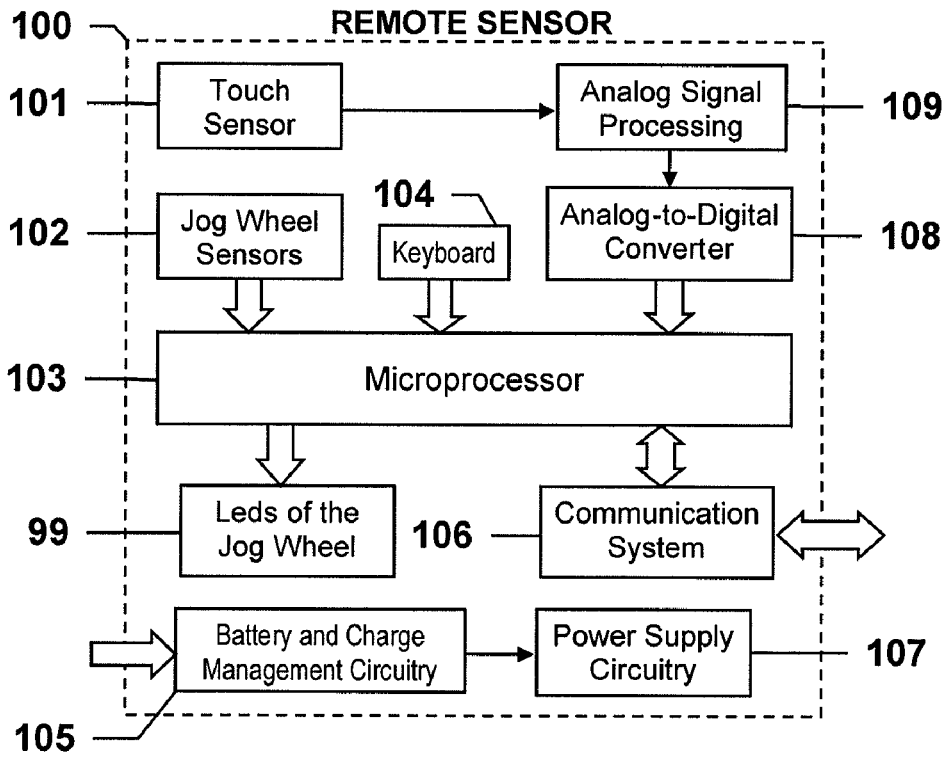
FIG. 6—is a block diagram of the first modality of the remote sensor, in reference to the second preferred embodiment of the device object of the present invention.

FIG. 6 presents a block chart of the first modality of the remote sensor 100, in reference to the second preferred embodiment of the device. The remote sensor 100 is built to send processed commands to the processing unit 1,10,20,50, 80. This sensor has a rechargeable battery and charge management circuit 105, as the power supply circuit 107 provides regulated voltages to supply the remaining circuits.

At least one touch sensor 101 is placed under the surface of the Jog disk 127, and it detects beats/touches by the hand and/or fingers of the user, sensitive to frequency and intensity. The touch sensor 101 can be a piezoelectric transducer, field effect, or a pressure, force, vibration or acceleration sensor. The signals of these sensors are conditioned through the analog signal processing 109 and converted into digital words by means of an analog-to-digital converter 108, since the data is read by the Microprocessor 103. The Jog disk sensors 102, which inform the speed and angular position of the disk, send signals to the microprocessor 103.

The microprocessor 103 also does the keyboard 104 reading, besides sending resulting processed data to the communication system 106, which is compatible and identical to the communication system 106 of the processing unit 100. The microprocessor 103 receives instructions by means of a communication system 106 to actuate the leds of the Jog disk 99, which are placed under the surface of the Jog disk 127.

Figure 7:
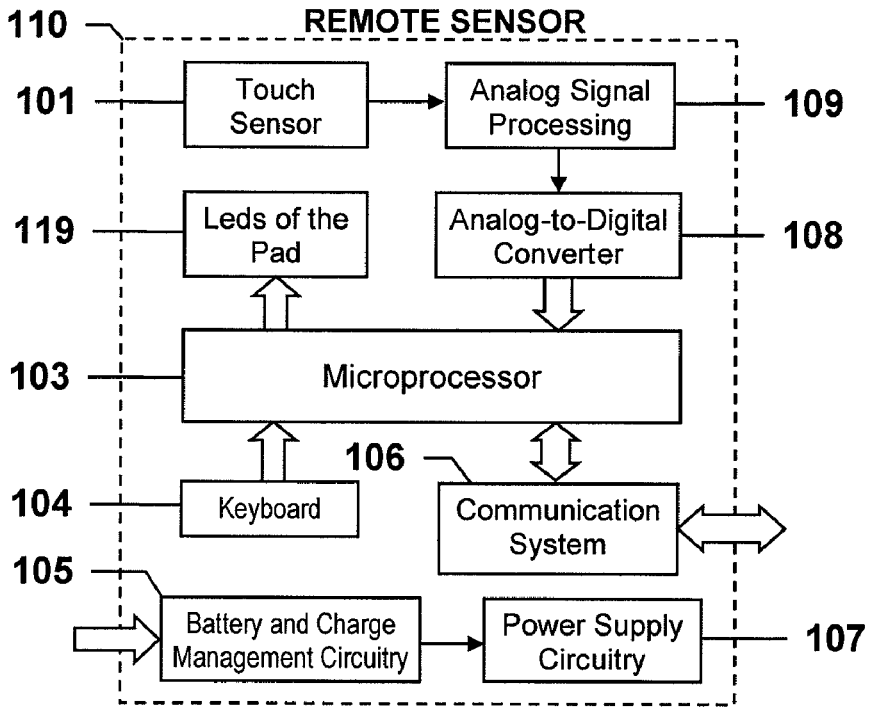
FIG. 7—is a block diagram of the second modality of the remote sensor, in reference to the second preferred embodiment of the device object of the present invention.

The block diagram of the second modality of the processing unit 110, in reference to the second preferred embodiment, is presented on FIG. 7. This sensor is identical to the first modality of the remote sensor 100, with the exception of having a pad 169 in place of a Jog disk 127. Thus, the block diagram of the second modality does not present Jog disk sensors 102 and the leds refer to the pad, called leds of the pad 119 for being under its surface.

Many touch sensors can be spread out under the Jog disk 127 or pad 169 to provide different touch-sensitive regions, assigning distinct functionalities for each. With this multiplicity of sensors, the user can, for instance, act on various commands, or produce instrumental and/or different musical note sounds, change parameters or concurrently insert different effects or not, into the playing music.

Figure 8:
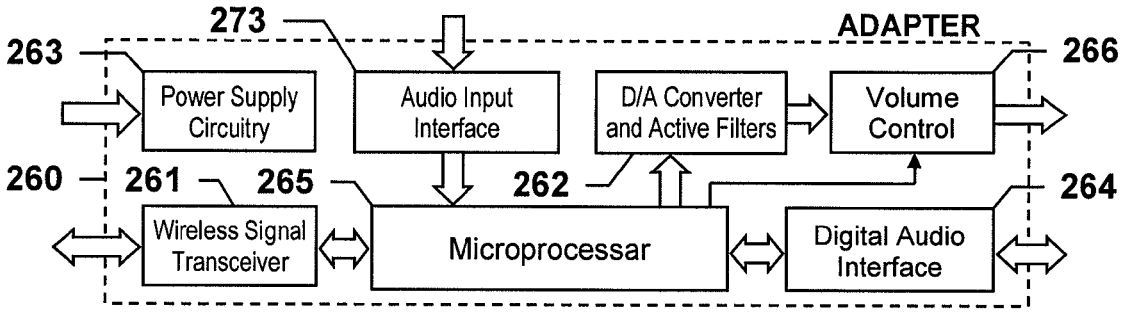
FIG. 8—is a functional block diagram of the first adapter's modality and object of the present invention.

The block diagram of the first modality of the adapter 260, which acts in all modalities of the processing unit 20,50,80, is presented on FIG. 8. This adapter allows the processing unit 20,50,80 to receive and/or send sounds and data to audio and video equipment.

An external power source connected to the adapter 260 supplies power to the power supply circuit 263, which provides regulated voltages to the other circuits. The wireless signal transceiver 261 is identical and equivalent to the wireless signal transceiver 43 of the processing unit 20,50,80, forming a communication pair. This transceiver receives digitized data, which are red by the microprocessor 265, which also sends data to the transceiver.

Any device can supply an analogical audio signal to the adapter 260, in which this signal is treated and converted to analogical words by means of an audio input interface 273, which sends these words to the microprocessor 265.

The resulting sound of the processing unit 20,50,80 received by the adapter 260 is decoded by the microprocessor 265 and sent to the D/A (Digital to Analogical) converter and active filters 262, recomposing the analogical signal. This signal passes through a volume control circuit 266, which adjusts its intensity and is controlled by the microprocessor 265, being made available in standard audio channel form to enter any audio and/or video equipment. The digital audio interface 264 is another option for the input or output of digitized audio, being compatible with any audio/video equipment.

Figure 9:
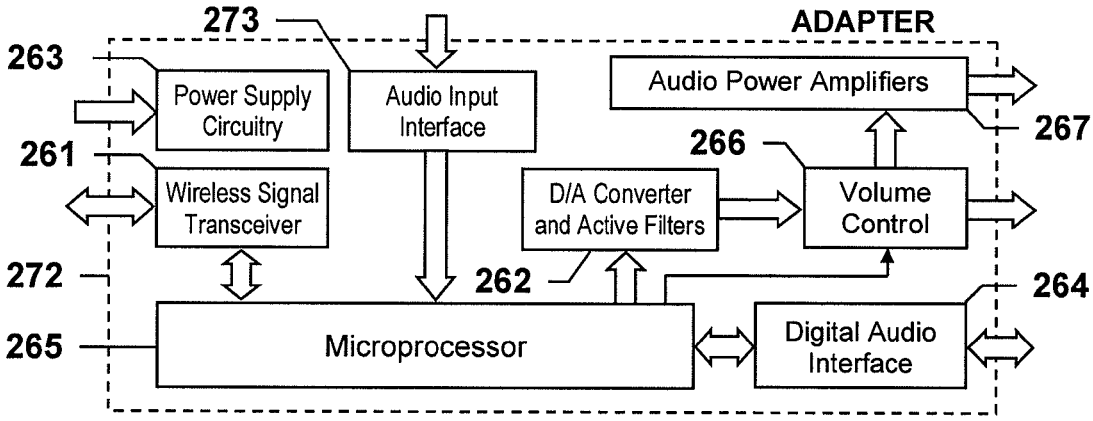
FIG. 9—is a functional block diagram of the second adapter's modality and object of the present invention.

FIG. 9 shows the block diagram of the second modality of the adapter 272 acting in all modalities of the processing unit 20,50,80. This adapter is identical to the first modality of the adapter 260, with the exception of including audio power amplifiers 267 for direct power output to the speakers.

Figure 10:
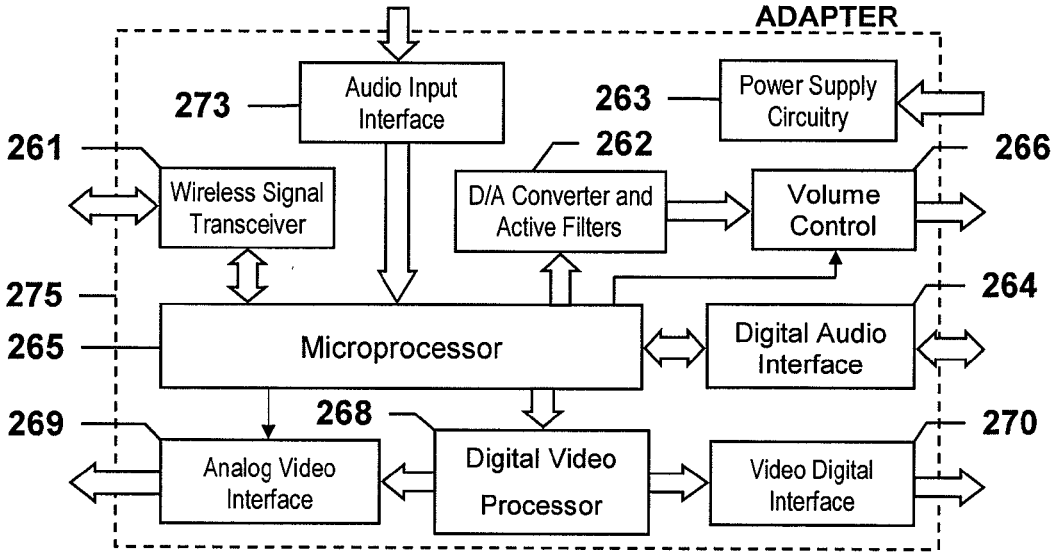
FIG. 10—is a functional block diagram of the third adapter's modality and object of the present invention.

The block diagram of the third modality of the adapter 275, which also acts in all modalities of the processing unit 20,50, 80, is presented on FIG. 10. This adapter incorporates the circuits and functionalities of the first modality of the adapter 260, including the means to provide a video, analogical or digital signal. To this end, the processing unit 20,50,80 sends data and/or commands in reference to characters, points, figures, images or photos to the adapter 260, by means of a wireless signal transceiver 261. These data and/or commands are decoded and pre-processed by the microprocessor 265, which sends the resulting data to the digital video processor 268. This processor is responsible for image formation, sending it to the video digital interface 270 and to the analog video interface 269, which respectively provide digital and analogical video signals. These signals that leave the adapter 275 are compatible with the existing video standards, providing images for a TV or projector.

Figure 11:
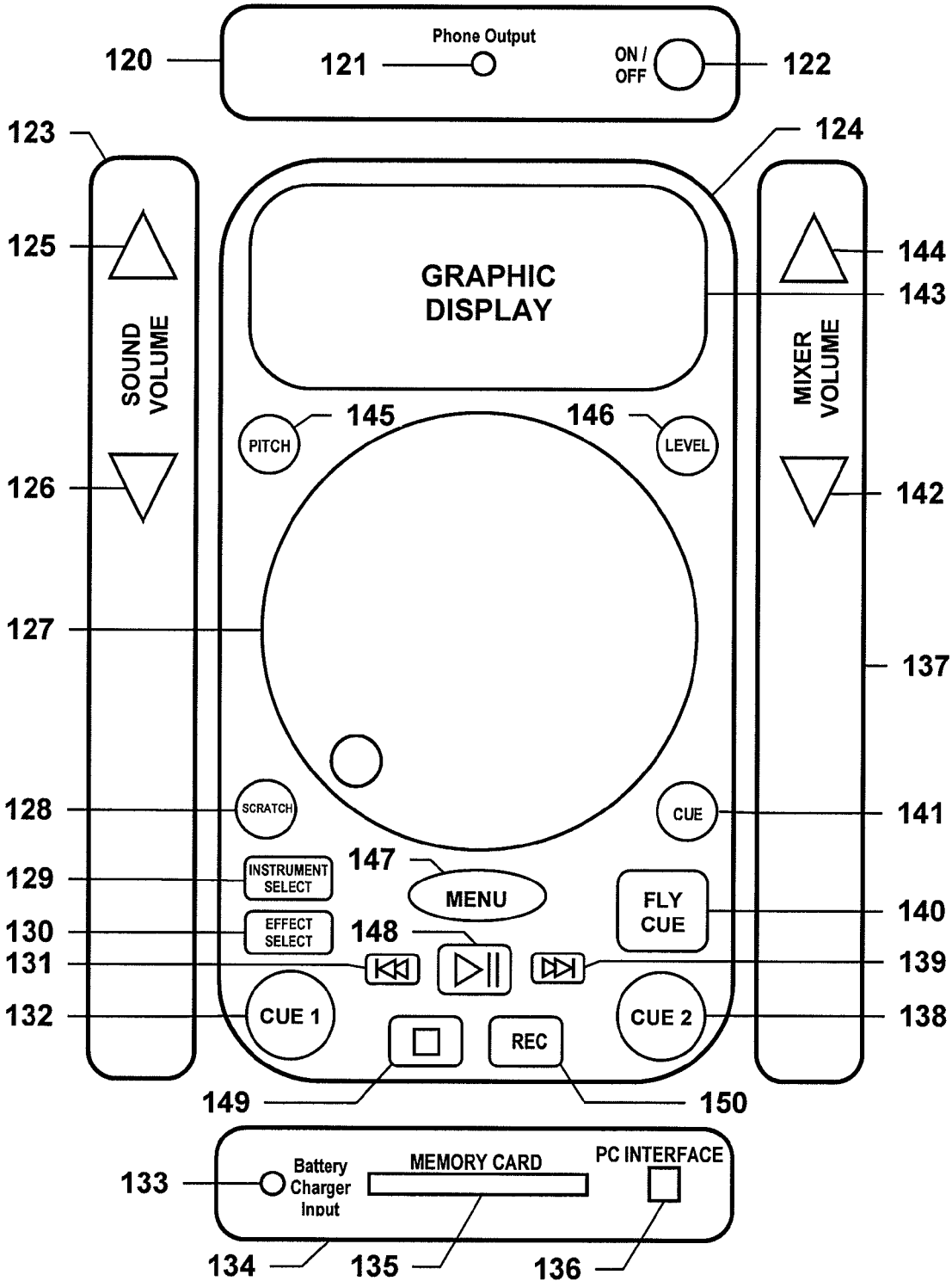
FIG. 11—views of the front side, upper side, lower side, left side and right side of the first modality of the processing unit, in reference to the first preferred embodiment of the device object of the present invention.

FIG. 11 shows the upper side 120, frontal side 124, right side 137, left side 123 and lower side 134 of the first modality of the processing unit 20. The upper side 120 has an on/off key 122 for the unit and a connector for an earphone and microphone 121. The left side 123 has two keys for produced sound control 126, 125, while the right side 137 there are two keys for setting resulting and master volumes 142, 144. The lower side 134 has connector for the entry of the battery charger 133, memory card entry 135 connector and a computer connector 136.

The main commands are on the front side 124. The graphic display allows the user to see menus and sub menus, name of songs, play list, volume settings, graphic equalizer, battery meter, communication monitors, accompaniment signals, different icons as well as application interface graphics.

The Jog disk 127 acts in the production of musical instrument sounds (percussion, keyboard, string or blow instruments), sound effects, changes play parameters of a song or sound, can be used in assisting menu browsing, acts in application control as well as being touch sensitive.

The basic music control functions are in the following keys: STOP 149, which cancels play; Fast-Forward/Next-music 139, which fast forwards the playing track or jumps to the next track; Fast-Rewind/Previous-music 131, which rewinds the playing track or plays the previous track and; PLAY/PAUSE 148, which begins playing the music selected or pauses it. The REC key 150 makes it possible for the instrument sounds (percussion, keyboard, string or blow), sound effects or resulting sound to be recorded, being stored in the form of data or files in flash memory storage 35, or in memory card 5. From the MENU key 147, it is possible to access the system submenu menus, activate application and functions keys in general.

By acting as DJ, the user has different functions and resources. One of these resources is the cue function responsible for marking a spot to begin playing a song. It is therefore necessary to pause the song by pressing PLAY/PAUSE 148, set the exact point by spinning the Jog disk 127, or acting on the pad 169, and pressing CUE 141. When the user wishes to return to the memorized point, he just needs to press CUE 141. Another similar function is given by the FLY CUE key 140, which marks a point on the song playing, allowing the song to be restarted from the point marked by the CUE key 141. CUE (1) 132 and CUE (2) 138 make it possible to mark two extra points.

Another important function of the instrument is the music play speed setting (pitch function). Through PITCH key 145, the pitch is set through the Jog disk 127 or pad 169. A point on the song can be marked without the need to pause the song by just pressing FLY CUE 140 at the desired moment. The SCRATCH key 128 simulates music stop and controlled play from the Jog disk 127 or pad 169.

The processing unit 20 can produce several musical instruments such as percussion instruments, keyboards, string instruments or blow instruments, being selected through the INSTRUMENT SELECT key 129. Once a given instrument is selected, to produce its sounds, just beat the Jog disk surface 127 or pad 169, with the user's hand or fingers. The intensity of the beat will influence the instrument's sound intensity or its musical note. In addition, sound effects can be produced, such as: scratching, echo, frequency filters, play delay, stop or gradual play, in addition to different types of distortions in the music on play. Selection of the type of effect is through EFFECT SELECT 130.

Using the Through LEVEL 146 key, it is possible to set the difficulty level of the performance evaluation for the user in four levels: beginner with help, easy, medium and difficult.

Figure 12:
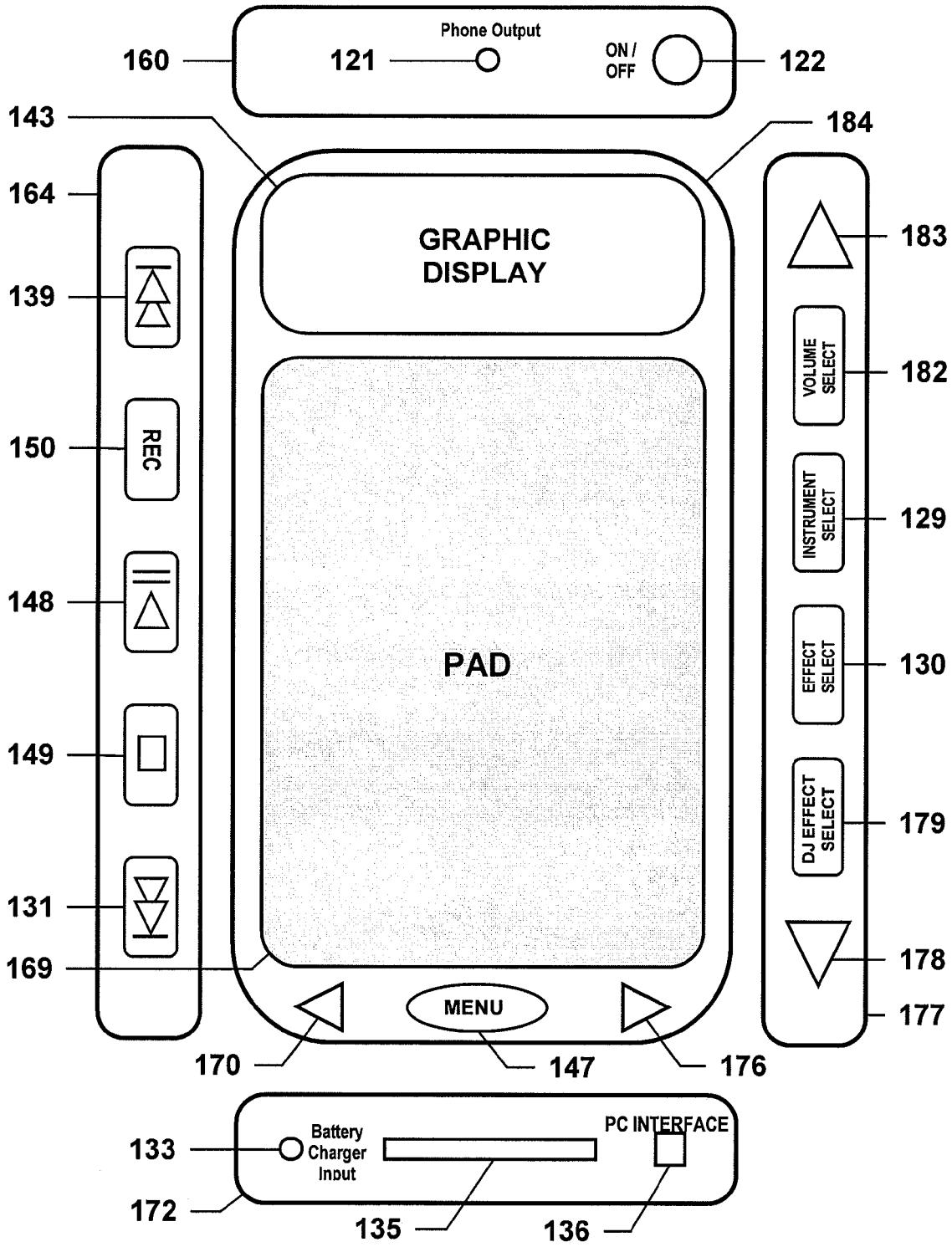
FIG. 12—views of the front side, upper side, lower side, left side and right side of the second modality of the processing unit, in reference to the first preferred embodiment of the device, object of the present invention.

Similar to the first modality, the second modality of the processing unit 50, in reference to the first preferred embodiment is shown on FIG. 12. The upper side 160 and lower side 172 are exactly equal to the first modality.

The left side 164 contains the keys corresponding to the basic music control functions: STOP 149, PLAY/PAUSE 148, Fast-Forward/Next-music 139 and Fast-Rewind/Previous-music 131 and REC 150 for sound recording. On the right side 177, there are four keys for parameter selection and two keys for settings 183, 178. The DJ EFFECT SELECT key 179 makes it possible to select one of the major effects available (pitch, scratch, cue, fly cue, among others). The VOLUME SELECT key 182 changes between volume of produced sound and master volume. Different types of musical instruments (percussion, keyboards, string or blow) can be selected through INSTRUMENT SELECT 129. Sound effects, such as echo, filter, noise, distortions, among others, can be selected through the EFFECT SELECT key 130. The keys in the form of an arrow 183, 178 act in setting the selected parameter.

From MENU key 147 and browsing keys 170, 183 or the pad itself 169, it is possible to access the system submenu-menus, activate application and function keys in general. The pad 169 consists of a touch-sensitive surface that acts in the production of instrumental sounds (percussion, keyboard, string or blow), sound effects, changing of play parameters and control of applications, functions and menus.

Figure 13:
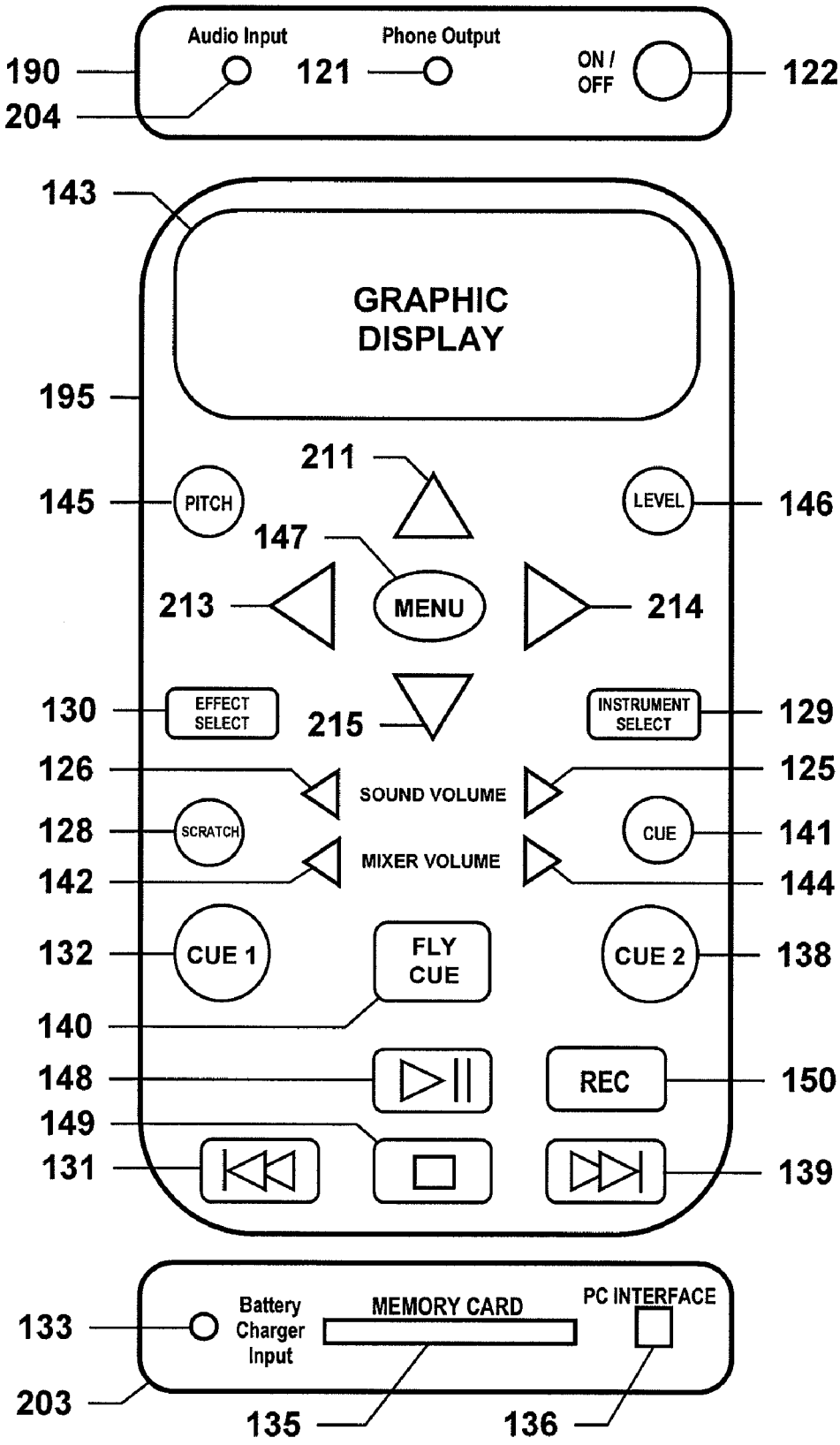
FIG. 13—views of the front side, upper side and lower side of the third modality of the processing unit, in reference to the second preferred embodiment of the device, object of the present invention.

The external details of the third modality of the processing unit 80, in reference to the second built model, are shown on FIG. 13. The keys and elements already mentioned will not be repeated in this case as they have identical characteristics. On the front side 195, there is a set of browsing keys 214,215, 213,211 arranged in such manner as to facilitate menu browsing, improve interaction with applications and functions of this unit. The upper surface 190 also provides a connector for audio input 204, from a portable player 17.

Figure 14:
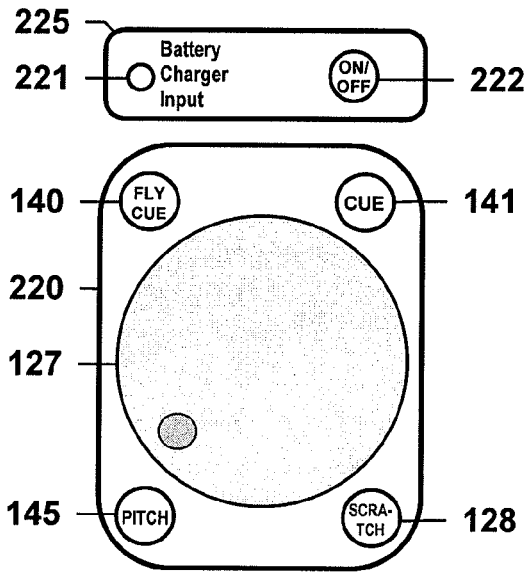
FIG. 14—views of the front side and upper side of the first modality of the remote sensor, in reference to the second preferred embodiment of the device object of the present invention.

FIG. 14 presents the front side 220 and upper side 225 of the first remote sensor modality 100, in reference to the second preferred embodiment. The upper side 225 has an on/off key 222 for this sensor, and a connector for the battery charger 221. On the front side 220, there is a Jog disk 127 and four quick function keys: FLY CUE 140, CUE 141, PITCH 145 and SCRATCH 128. These keys conduct the same functions when associated to the processing unit 80 as the ones treated previously.

Figure 15:
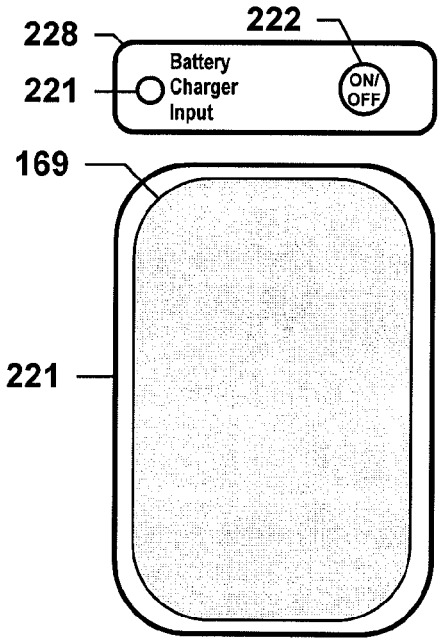
FIG. 15—views of the front side and upper side of the second modality of the remote sensor, in reference to the second preferred embodiment of the device object of the present invention.

The front side 221 and upper side 228 of the second remote sensor 110 modality, in reference to the second built model of the instrument, are shown on FIG. 15. The upper side 228 is identical to the upper side 225 of the first modality. The front side 221 has a touch sensitive surface or pad 169.

Several leds are arranged under the surface of the Jog disk 127 and pad 169. The illuminated region or point on the surface correspond to the touch point and the luminous intensity, which is controllable, and is related to the force or pressure to be applied. The combination of these leds also provides luminous indication in the form of arrows, circles, squares, and other geometric formats, in addition to figures and symbols to indicate functionalities, functions, commands and, aid and improve the use of the device.

An important characteristic of the Jog disk 127 and pad 169 is that their surfaces are composed of a soft rubber or cushioned material, which is semitransparent or transparent to light, allowing the luminosity of the leds 37,65,99,119, placed below the surface, to be properly seen by the user. For example, when a future action is of the type "spin Jog disk 127 clockwise at maximum intensity", a group of leds arranged in arrow form should light up in a sequence in reference to the rotation and the intensity will inform the pitch to be applied. Thus, the user notices the rotation's direction and how fast he should rotate, observing the speed of the arrow formation and its luminous intensity. Another reason for the Jog disk 127 and pad 169 surfaces to be soft is to prevent hand and/or finger injury due to repetitive touches/impacts.

The pad 169 has several touch sensors associated to its surface regions or points, as well as leds 65, 119 distributed under the surface to indicate functionalities, functions, commands and also assist and improve the use of the instrument. In this case, to simulate the rotation of the Jog disk 127, the user should slide or drag his hand/fingers over the pad 169. The speed, movement direction and intensity are detected by the sensors in place and converted in rotation direction and speed equivalent to the Jog disk 127.

Figure 16:
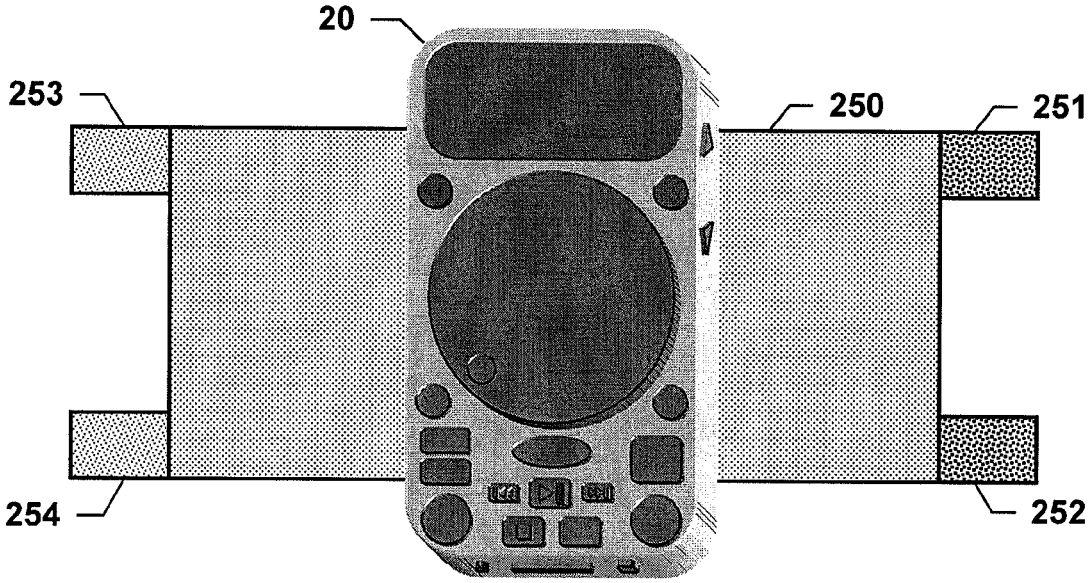
FIG. 16—is a spatial view of the first modality of the processing unit, in reference to the first preferred embodiment of the device object of the present invention.
Figure 17:
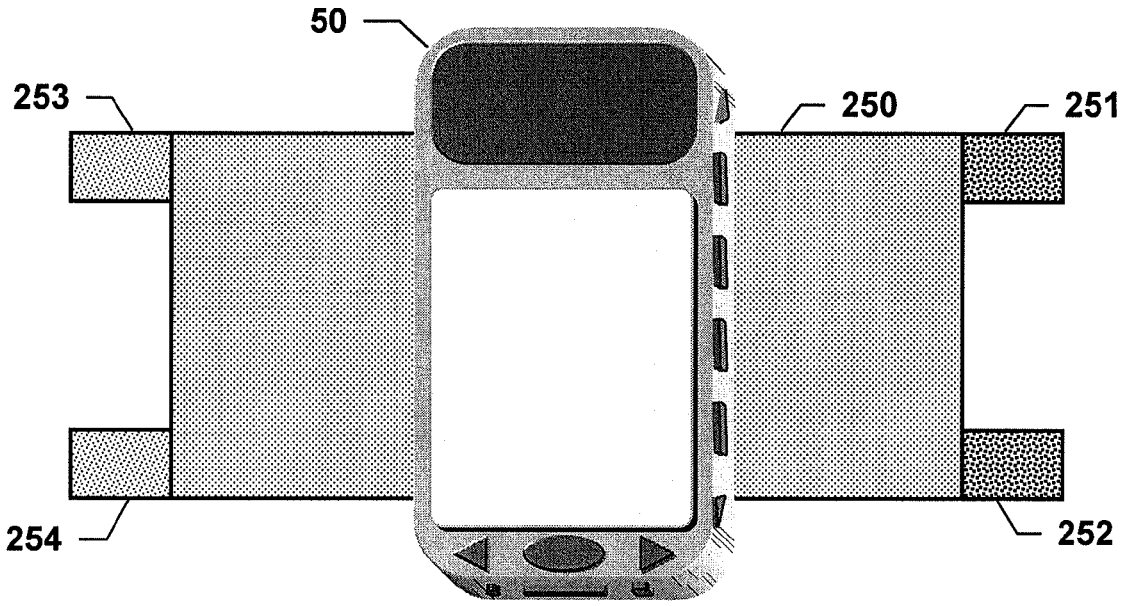
FIG. 17—is a spatial view of the second modality of the processing unit, in reference to the first preferred embodiment of the device object of the present invention.
Figure 18:
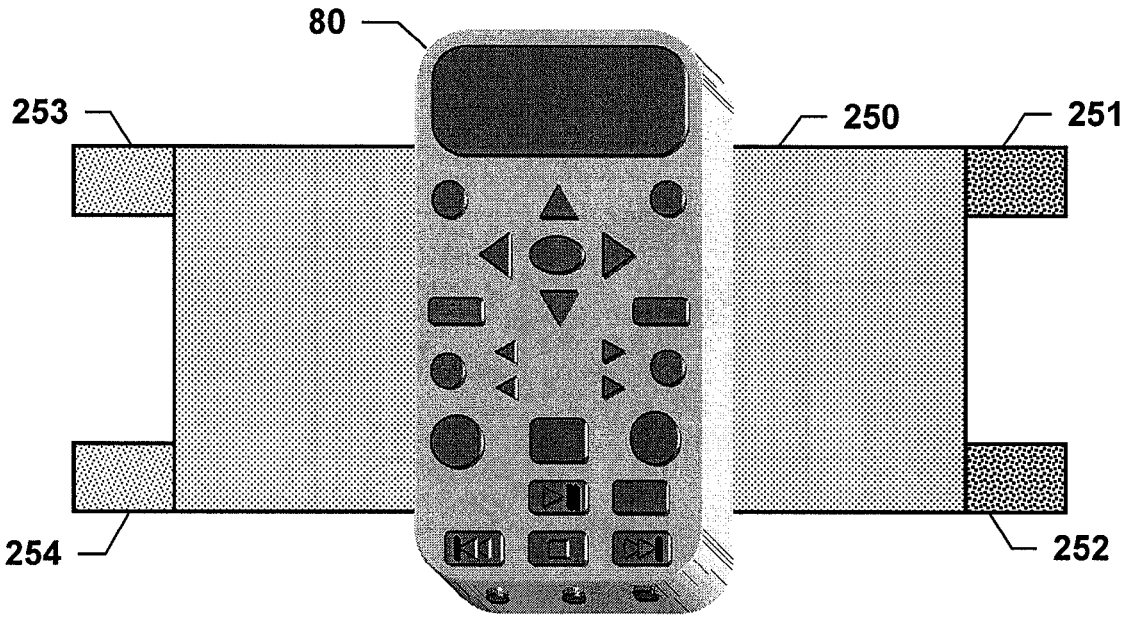
FIG. 18—is a spatial view of the third modality of the processing unit, in reference to the second preferred embodiment of the device object of the present invention.

FIG. 16 shows a spatial vision of the first modality of the processing unit 20, which is strapped by an adjustable elastic belt 250 with Velcro straps or adhesive parts 251,252,253, 254. In the same way, the second modality of the processing unit 50 is shown on FIG. 17. The third and last modality of the processing unit 80 is presented on FIG. 18.

Figure 19:
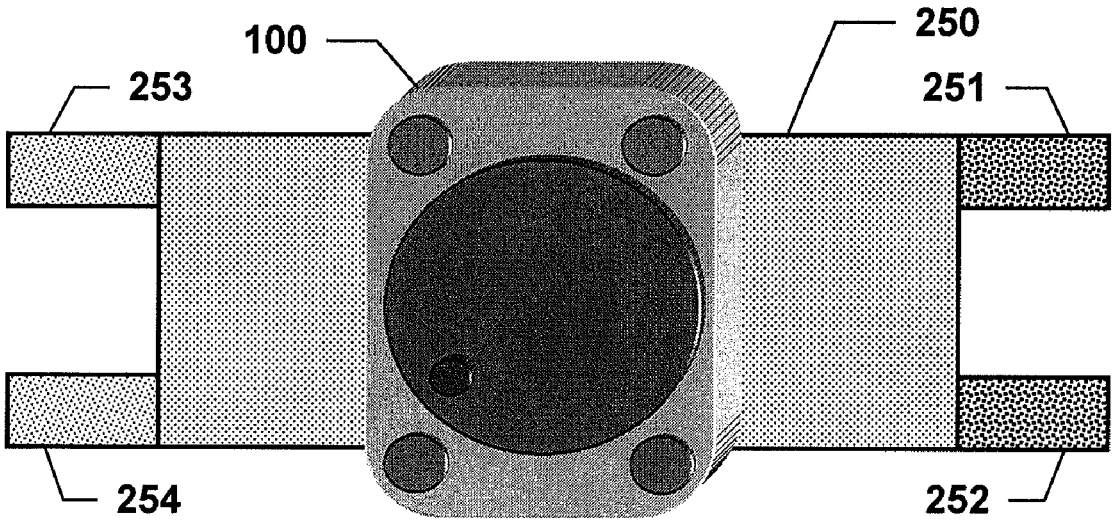
FIG. 19—is a spatial view of the first modality of the remote sensor, in reference to the second preferred embodiment of the device object of the present invention.
Figure 20:
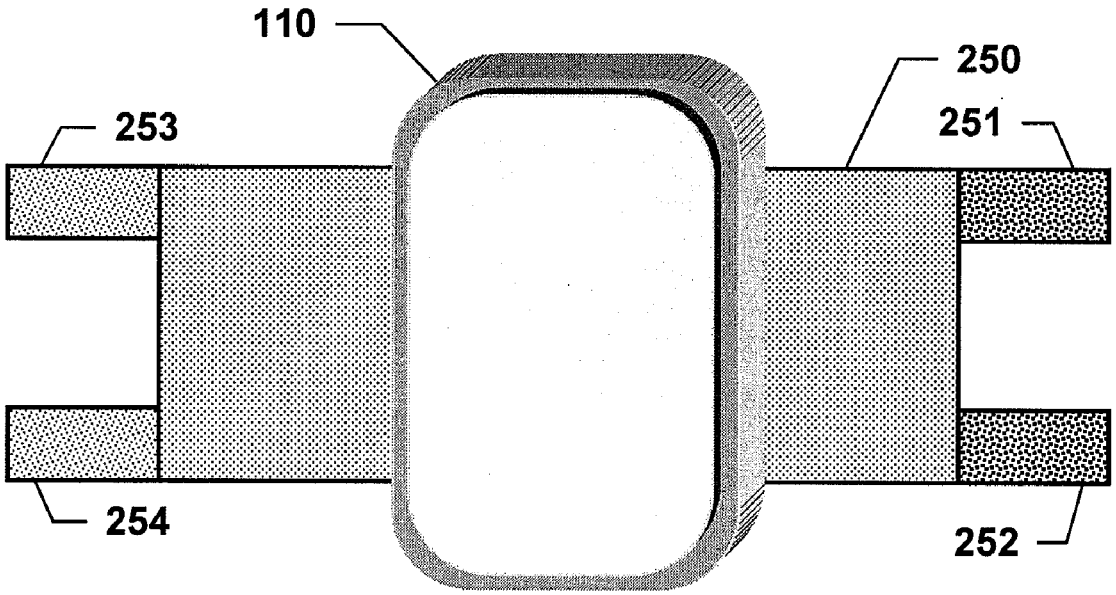
FIG. 20—is a spatial view of the second modality of the remote sensor, in reference to the second preferred embodiment of the instrument object of the present invention.

FIG. 19 shows a spatial vision of the first modality of the remote sensor 100, which is strapped by an adjustable elastic belt 250 with Velcro straps or adhesive parts 251,252,254, 253. In a similar way, FIG. 20 shows the second modality of the remote sensor 110.

The adjustable elastic belt 250, present in all modalities of the processing unit 20,50,80, and remote sensor 100,110, has Velcro straps or adhesive parts 251,252,254,253 that allow for ergometric positioning safely and correctly onto the user's body.

Considering all modalities for the processing unit 20,50,80 and remote sensor 100,110, these elements are composed of a box or casing with a display, keyboard and contact surface (pad or Jog disk). Inside this box are installed printed circuit boards, electronic components, communication modules, rechargeable battery, connection wires, mechanical supports and other elements to compose the electronic circuit and mechanical structure. The adapter 260,272,275 is encapsulated in a box or casing that contains a printed circuit board, electronic components, connectors, wires and mechanical fastening supports.

The instruments of this invention also have user applications such as: games, personal agenda, calendar, play list editor, sound settings, advanced configurations, file editor, contact list, alarm clock and clock. These applications are preferentially found in the processing unit 1,10,20,50,80.

The user interacts with the processing unit 1,10,20,50,80 or through the remote sensor 100,110, through the available controls to run the instrumental and/or vocal of a song or apply sound effects to it, where, by the end of the song, the user receives a score corresponding to his performance. In the case of instrumental accompaniment or use of sound effects, the evaluation considers the synchronism, touch intensity, Jog disk 127 or pad 169 movement, used musical instruments, instrumental notes used and types of effects during the activity.

Through the Jog disk 127 or pad 169 and incorporated functions into the processing unit 1,10,20,50,80, the user can assume the role of a DJ, having his DJ abilities evaluated. In addition to these functionalities, the device can also be used as a vocal karaoke to evaluate rhythm, synchronism, tone, timbre and intensity of the user's voice when singing, through the use of a microphone. The reference standards for the evaluated parameters are in the file composing the song or a specific karaoke file. These parameters are used for the calculation of the score/grade in reference to the user's performance, which is shown on the graphic display 28,143.

The difficulty level has the function of establishing a given rigor in the user's performance evaluation. They are divided into four levels: beginner with help, easy, medium and difficult. To such end, the evaluation parameters receive different weights and different standards are selected according to the defined level.

Once the processing unit 1,10,20,50,80 has a signal transceiver 43, the resulting sound can be sent to a sound system, as well as any domestic appliance, cell phone, TV, or appliance able to receive and play sound. The adapter 8,260,272,275 can be used to provide this sound in a non-enabled device and receive sound directly from the processing unit 1,10,20,50,80. An application of the adapter 8,260 includes a connection to a telephone of cell phone, making it possible to hear the sound of the processing unit 1,10,20,50,80 on this device and send, by call or data transmission, to another user away at the same time, allowing that user to also interact with this sound. In the same way, a domestic sound appliance with an adapter 8,260,272,275 connected to its audio input will receive the sound from the processing unit 1,10,20,50,80 and play it. The microphone or equipment signal to which the adapter 8,260,272,275 is connected can also be sent to the processing unit 1,10,20,50,80.

The adapter 8,275 can generate video, digital or analogical signals for a TV or projector to display the images, which correspond to an extension of the display 28,143 of the processing unit 1, 10, 20, 50, 80. Other types of images can also be displayed, such as photos or figures.

The processing unit 1,10,20,50,80 can also be used as a data storage unit for a computer, saving information and/or files in flash storage memory 35 or in the memory card 5. The stored data in these memories can be read by the computer 4.

The invention claimed is:

1. A portable electronic device for the production, playing, accompaniment and evaluation of musical sounds, comprising means to be associated to an audio system that produces musical sounds, the electronic device comprising:

a processing unit which produces musical instrument sounds, the musical instrument sounds being mixable with the musical sounds, the processing unit comprising a digital signal processor and a microprocessor;

touch-sensitive sensors arranged under a translucent touch-sensitive surface, the touch-sensitive sensors being activated by touches of a user and generating signals that are processed by the digital signal processor to produce the musical instrument sounds;

the touch-sensitive sensors being arranged under the touch-sensitive surface and providing touch-sensitive regions that are sensitive to touches; and LEDs distributed under the touch-sensitive surface, the LEDs being controlled by the microprocessor to provide a luminous indication sequence according to the musical sounds played by the audio system, the device being configured in such a manner that the luminous indication sequence indicates to the user a spot of the touch-sensitive regions that should be touched as well as the moment the spot should be touched and an intensity with which the spot should be touched.

2. The portable electronic device according to claim 1 wherein the touch-sensitive surface is a jog disk.

3. The portable electronic device according to claim 1, wherein the touch-sensitive surface is a pad.

4. The portable electronic device according to claim 1, wherein the LEDs are configured to illuminate a region or a point of the touch-sensitive surface.

5. The portable electronic device according to claim 4, wherein the touch-sensitive regions are configured such that each region will provide a different command to produce different instrumental or different musical note sounds.

6. The portable electronic device according to claim 5, wherein the touch-sensitive regions are configured such that each region will change parameters of musical sounds played or concurrently insert different effects into the musical sounds played.

7. The portable electronic device according to claim 6, wherein the LEDs are configured in such a manner that the combination provides a luminous indication in the form of geometric shapes and to indicate functions of the electronic device.

8. The portable electronic device according to claim 7, wherein the processing unit is associable to a remote touch-sensitive sensor by means of a communication system, the communication being made by means of radio frequency, ultrasound or infrared light or by means of electric wiring, as well as an association of two or more of these means of communication to sending and receiving commands generated by the touch-sensitive sensors.

9. The portable electronic device according to claim 8, wherein the touch-sensitive sensors and the remote touch-sensitive sensor comprise at least one transducer of piezoelectric type, field effect, or a pressure, force, vibration or acceleration sensor.

10. The portable electronic device according to claim 1, wherein the touch-sensitive surface comprises a jog disk or pad.

11. The portable electronic device according to claim 10, wherein the touch-sensitive sensors are sensitive to frequency and intensity of touches.

12. The portable electronic device according to claim 11, wherein the processing unit is configured to evaluate the synchronism and touch intensity and the movement of the jog disk or pad in relation to the musical sounds, wherein reference standards for the evaluated parameters are previously stored in a file of the musical sounds being accompanied.

13. The portable electronic device according to claim 12, wherein the sound resulting from the processing unit and received by an adapter, enables the input into any audio or video equipment.

14. The portable electronic device according to claim 12, wherein the adaptor is capable of making a connection to a telephone or data transmission line, to another user, allowing that user to also interact with the transmitted sound by other touch-sensitive sensors.

15. The portable electronic device according to claim 12, wherein the device comprises an elastic belt with fabric hook-and-loop fastener straps or adhesive parts to strap the processing unit to the user's body.

16. The portable electronic device according to claim 12, wherein the processing unit is capable of changing play parameters of the musical sounds played.

17. The portable electronic device according to claim 12, wherein the jog disk or pad has a surface composed of a soft rubber or cushioned material.

18. A portable electronic device for the production, playing, accompaniment and evaluation of musical sounds, comprising means to be associated to an audio system that produces musical sounds, the electronic device comprising:

a processing unit which produces musical instrument sounds, the musical instrument sounds being mixable with the musical sounds, the processing unit comprising a digital signal processor and a microprocessor;

remote touch-sensitive sensors associable to the processing unit of the portable electronic device by means of a communication system;

the remote touch-sensitive sensors being arranged under a translucent touch-sensitive surface and providing touch-sensitive regions that are sensitive to touches, the remote touch-sensitive sensors being activated by touches of a user and generating signals that are processed by the digital signal processor of the electronic device, to produce the musical instrument sounds;

the device further comprising LEDs distributed under the touch-sensitive surface, the LEDs being controlled by the microprocessor of the electronic device to provide a luminous indication sequence according to the musical sounds played by the audio system, the device being configured in such a manner to indicate to the user a spot of the touch-sensitive regions that should be touched as well as the moment the spot should be touched and an intensity with which the spot should be touched.

19. The portable electronic device according to claim 18, wherein the remote touch-sensitive surface is a jog disk or pad.

20. The portable electronic device according to claim 19, wherein the remote touch-sensitive sensors comprise at least one transducer of piezoelectric type, field effect, or a pressure, force, vibration or acceleration sensor.

21. The portable electronic device according to claim 20, wherein the LEDs are configured to illuminate a region or a point of the surface of the jog disk or pad.

22. The portable electronic device according to claim 21, wherein the touch-sensitive regions are configured such that each region will provide a different command to produce different instrumental or different musical note sounds.

23. The portable electronic device according to claim 22, wherein the touch-sensitive regions are configured such that each region will change parameters of the musical sounds played or concurrently insert different effects into the musical sounds played.

24. The portable electronic device according to claim 23, wherein the communication with the remote touch-sensitive sensors is made by means of radio frequency, ultrasound or infrared light or by means of electric wiring, as well as an association of two or more of these means of communication to sending and receiving commands generated by the remote touch-sensitive sensors.

25. The portable electronic device according to claim 24, wherein the jog disk or pad has a surface composed of a soft rubber or cushioned material.

26. The portable electronic device according to claim 25, wherein the device comprises an elastic belt with fabric hook-and-loop fastener straps or adhesive parts to strap the processing unit to the user's body.

27. The portable electronic device according to claim 26, wherein the touch-sensitive sensors are sensitive to frequency and intensity of touches.

* * * * *